United States Patent [19]

Boisson

[11] Patent Number: 4,640,354

[45] Date of Patent: Feb. 3, 1987

[54] METHOD FOR ACTUATING A TOOL IN A WELL AT A GIVEN DEPTH AND TOOL ALLOWING THE METHOD TO BE IMPLEMENTED

[75] Inventor: Gérard Boisson, Melun, France

[73] Assignee: Schlumberger Technology Corporation, New York, N.Y.

[21] Appl. No.: 678,444

[22] Filed: Dec. 5, 1984

[30] Foreign Application Priority Data

Dec. 8, 1983 [FR] France ..... 83 19701

[51] Int. Cl.[4] ..... E21B 23/00; E21B 33/132

[52] U.S. Cl. ..... 166/250; 166/64; 166/162; 166/215; 166/376; 166/382

[58] Field of Search ..... 166/302, 57, 382, 64, 166/385, 250, 386, 381, 373, 376, 65 R, 317, 168, 164, 162, 214, 215, 217

[56] References Cited

U.S. PATENT DOCUMENTS

| | | | |
|---|---|---|---|
| 1,030,084 | 6/1912 | Guiberson, Jr. | 166/215 |
| 1,774,911 | 9/1930 | Abercrombie | 166/215 |
| 3,057,405 | 10/1962 | Mallinger | 166/302 X |
| 3,090,441 | 5/1963 | Smink et al. | 166/162 |
| 3,187,813 | 6/1965 | Green, Jr. | 166/162 X |
| 3,461,960 | 8/1969 | Wilson | 166/168 |
| 4,149,592 | 4/1979 | Burton et al. | 166/164 X |
| 4,390,291 | 6/1983 | Gaven, Jr. et al. | 374/160 |
| 4,523,640 | 6/1985 | Wilson et al. | 166/64 |

*Primary Examiner*—Stephen J. Novosad

[57] ABSTRACT

A downhole tool is actuated at chosen well depth by selection of a control element that melts at the chosen depth well temperature. In one form of tool, a fusible pin melts to release spring-loaded jaws which move against an expansion cone to anchor the tool in the well. In another form, a fusible receptacle cover melts to release a quantity of dense fluid under action of gravity. Suitable control elements are formed of bismuth, with lead and zinc.

11 Claims, 3 Drawing Figures

METHOD FOR ACTUATING A TOOL IN A WELL AT A GIVEN DEPTH AND TOOL ALLOWING THE METHOD TO BE IMPLEMENTED

BACKGROUND OF THE INVENTION

1. Technical Field

This invention relates to downhole working in boreholes, as in the case of oil or geothermal wells.

2. Background Information

During prospecting and production operations, it is often necessary to anchor a tool in a borehole at a chosen depth. More generally, many types of tools are designed to be actuated at a well-determined depth: this is the case, for example, of a cement dump bailer which must be discharged at the depth at which a well is to be closed off.

The conventional procedure consists in first lowering the tool by means of a cable to the desired depth determined by the unreeled length of cable. The tool is then anchored in the production tubing. Then, the actual control of the tool is achieved by repeated pulling exerted from the surface via the cable until the failure of one or more pins. When the cable used is an electric cable, it is possible to use explosive means controlled electrically from the surface. All prior art systems are of the abrupt-action type, which is considered to be necessary in this technique in order to avoid inadvertent triggering of the tool other than at the desired depth.

For traction actuation, the calibration of the fracture pin(s) must be defined carefully and the tool control operations require the securing of the tool in the well. As regards explosive techniques, which are applicable only when an electric cable is used, they also require quite rigorous safety precautions well known to those of the art.

Finally, certain wells having a particular configuration oppose the use of conventional downhole tool triggering techniques. This is the case in particular of wells which exhibit a local restriction beyond which the tool must be triggered. This restriction makes difficult and even impossible the passage of a tool equipped with anchoring means. It may also be mentioned that the control of a tool by pulling on the cable is poorly suited to deviated wells.

SUMMARY OF THE INVENTION

The present invention provides a satisfactory solution to these problems.

It is thus a primary object of the invention to provide means for triggering a tool in a borehole which reconciles a soft action mode with as great a reliability as prior art techniques.

Another object of the invention is to provide triggering means which are soft and yet quite rapid, notably for the control of tools such as cement bailers.

A further object of the invention is to allow the actuation of tools at depths and/or in wells in which this has hitherto not been possible.

Finally, it is an object of the invention to provide a technique for triggering a tool in boreholes, capable of being easily adapted in the field according to requirements.

For this purpose, the invention proposes first of all a method for actuating a tool in a well at a chosen depth.

This method comprises the following operations:

(a) Determining the temperature of the well at the chosen depth.

(b) Equipping the tool with a control element made of a material capable of melting at a tempeature near the temperature thus determined.

(c) Lowering this tool to the desired depth, and waiting there for the actuation of the tool by the melting of the control element.

This technique is effective in every case, but is particularly useful in the case of wells having a restricted and/or highly deviated passage.

In current embodiments of the method, energy is stored in the tool and is then released by the melting of the control element.

At the present time, it is considered desirable that the melting temperature of the material forming the control element be defined with an accuracy of plus or minus 5° C., and preferably plus or minus 2° C. approximately.

In practice, a material is chosen which has a melting temperature equal to or slightly lower than the temperature of the well at the desired depth. This can be determined by direct measurement using a temperature probe or by the measurement or even the estimation of the temperature gradient along the well. The waiting time to be complied with to obtain the triggering of the tool is related to the time necessary for the thermal equilibrium between the tool and the well fluid when the tool has reached the desired depth. It is generally a fraction of this time.

The invention also provides downhole tools allowing the implementation of this method.

In a general definition of such a tool, it comprises, in combination, mechanical means capable of being loaded on the surface for storing energy, as well as at least one control element melting at a predetermined temperature and whose melting ends said storage.

According to another definition, the tool comprises two parts normally subject to relative motion, as well as a control element made up of a fusible part securing the two parts against said relative motion.

In a first embodiment of the tool, the two parts are subjected to relative motion in relation to each other upon encountering an elastic return. The control element comprises a lock such as a fusible pin securing the two parts in relation to each other in the tensioned position of the elastic return.

One of the current requirements in the manipulation of tools lowered into wells is the anchoring of these tools in the well. It is readily possible to provide anchoring means by equipping one of the parts with jaws supported movably with axial sliding on a rod terminating in an expansion cone toward which the jaws are loaded by the elastic return.

The anchoring can thus be obtained without requiring repeated pulling by means of the cable or equivalent means.

According to another embodiment of the invention, one of the two parts of the tool forms a receptacle containing the other part against movement under the action of gravity. One thus obtains, for example, a cement bailer consisting of a receptacle provided with an opening which can be closed by a plug.

The applicant has observed that certain special metallic alloys exhibiting all the desired properties for use in wells are capable of melting practically cleanly at any chosen temperature between about 45° and 400° C., the temperature accuracy being ±2° C., or better.

BRIEF DESCRIPTION OF THE DRAWINGS

Other characteristics and advantages of the invention will appear from the following detailed description given in connection with the appended drawings in which.

DESCRIPTION OF PREFERRED EMBODIMENTS

Figure 1A:
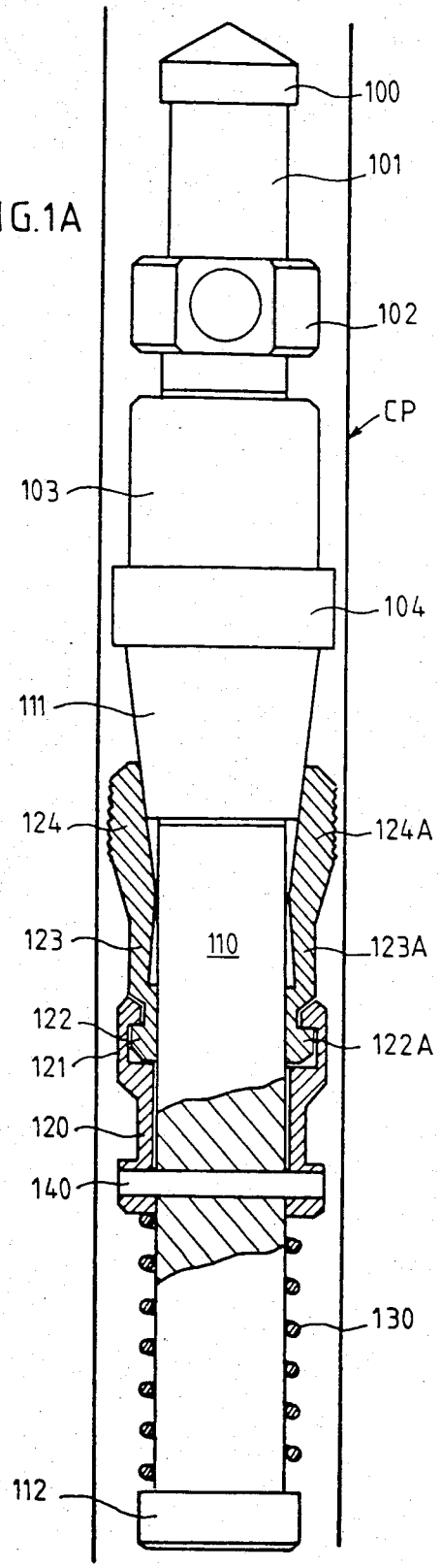
FIGS. 1A and 1B represent an anchoring tool according to the present invention.

Equipment lowered into oil and/or geothermal wells operates under very specific conditions in which it undergoes exceptional pressure and temperature stresses.

Thus, to actuate a tool in a well it is recognized that it is necessary to:

equip this tool with an element capable of breaking under a well-determined load, which has to be adjusted, lower this tool to the desired depth, anchor it there, exert repeated pullihng from a distance, generally by means of a cable, until the fracture of said element.

In certain cases, as in the case of cement bailers, it is possible to use explosive means remote controlled by an electric cable from the surface. The explosion then opens the gate which releases the cement at the desired depth in the well. In addition to the fact that it has no general application, this exlosive technique has serious drawbacks related, firstly, to the existence of the explosion and, secondly, to the combustion scrap and other debris resulting therefrom.

The present invention offers a very different solution, unknown up to the present time, for the triggering of tools lowered into oil or geothermal wells. This solution is based upon the application of specific metals or metallic alloys capable of melting at a well-determined temperature definable within a narrow range such as ±5° C., or better, ±2° C.

Although different types of materials may meet this condition, the applicant presently prefers to use the "fusible" alloys sold by Société Braconnot in Paris, France.

By varying the proportions of the elements composing this alloy, it is possible to define with great accuracy its melting point, which can go down to about 45° C. This material is easily machinable and has melting properties sufficiently clean to give satisfaction.

It is known that wells, and notably oil wells, are the scene of a temperature gradient, the temperature increasing on the average by about 1° C. every 30 meters. Although this temperature variation is not rigorously linear, it remains substantially monotonic and exhibits, with depth, only plateaus or small variations. It has been found that this situation is compatible with the use of the melting of an alloy as defined above for the release of energy stored on the surface and in the tool.

Under certain circumstances, very precise measurements are made of the temperature profile of a well as a function of depth, to within 1° C. Independently of precise measurements, for any well, the temperature of the well as a function of depth is generally known to within a few degrees. When it is desired to actuate a tool in a well at a chosen depth, it is thus possible to determine the temperature of the well at this depth to within 1° or 2° C.

As previously indicated, the tool is equipped with a control element made of a material such as the above-mentioned alloy, chosen so that its melting temperature is near the temperature of the well thus determined at the desired depth. The tool is lowered to this depth to await actuation by the melting of its control element.

It has also been observed that any tool penetrating into a well does not immediately acquire the temperature of the well at its location. The latency time necessary for the tool to be in thermal equilibrium with the well when the tool is stopped at a well-determined location is currently of the order of ten minutes or so. The fusible material is thus chosen so that its melting temperature is equal to or preferably lower than the temperature of the well at the desired depth. It has then been observed that the melting takes place in a few minutes, thereby actuating the tool.

The energy stored on the surface in the tool can be of various kinds: it may consist of a hydrostatic pressure difference or the energy of a precalibrated spring, for example. In the first case, a material is stored in the tool that has a density higher than the density of the fluid filling the well at the desired depth. The fusible control element will, by opening a gate, discharge this material from the tool. The energy storage is then comparable in this case to the storage of matter and this matter is associated with energy which depends on the difference in the densities of said matter and of the fluid filling the well.

This is the case of a cement dump bailer or any other body having a density higher than that of the fluid in the well. Other examples include sand or gravel.

The invention is applicable to most downhole tools in which it is necessary to maneuver a liner under difficult conditions or when shocks are detrimental to its operation, which rules out the use of prior art cables. This corresponds to the second case, namely the mechanical storage of energy by means of a precalibrated spring or equivalent means.

Figure 1B:
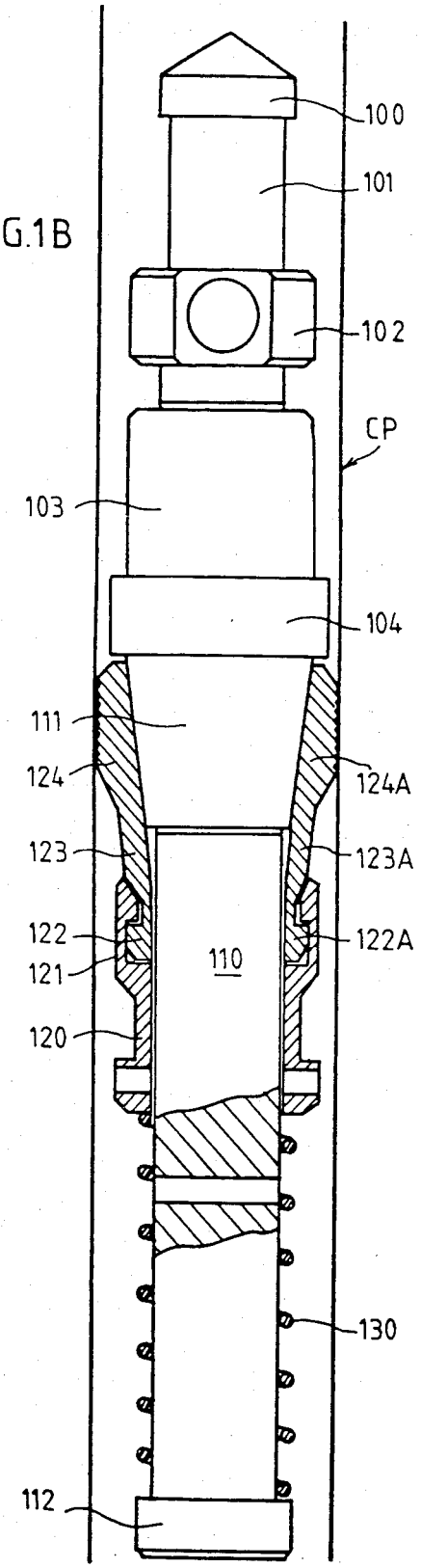

FIGS. 1A and 1B illustrate a first embodiment of the present invention allowing the anchoring of a tool in a well.

The tool is illustrated inside a production tube CP. It comprises a head bushing 101 equipped at one end with a flange 100 and on the other end with attachment means 102.

To lower it into the well, the head 101 is fixed to the end of a nonconducting cable by means of a setting tool. The body of the tool is otherwise of a generally cylindrical form. Below the element 102, it includes a solid cylinder 103 followed by another flange 104. This flange defines the maximum outer diameter of the tool in its rest position before anchoring.

The shoulder 104 is followed by a conical body 111 which tapers down to a central cylindrical rod 110. At its lower end, the rod 110 is provided with a flange 112.

On the rod 110 is slidably mounted an annular body member 120 whose upper part defines an annular recess 121. Into this recess 121 are inserted the feet 122 and 122A of two anchoring elements 123 and 123A whose other ends form dogs or jaws (operating in extension) 124 and 124A.

The insides of the jaws 124 and 124A are flared upwardly. In the rest position, they bear on the beginning of the expansion cone 111.

The bottom of the annular member 120 forms a stop for a spring 130 which also bears on the upper shoulder of the flange 112 already mentioned. In the rest position of the tool, a pin 140 goes through the rod 110 to secure the annular member 120 in a position in which the spring 130 is under compression.

The pin 140 is made of a fusible material according to the invention.

In operation, the tool is lowered to the desired depth after having placed therein a pin 140 melting at the corresponding temperature.

After the melting of the pin 140, which takes place after a few minutes, the spring 130 loads the ring 120 upwardly which in turn pushes the jaws 124 and 124A so that they are moved outwardly by the cone 111 and engage on the production tubing CP, thus anchoring the tool.

This anchoring function is thus obtained without any shock. Moreover, the means used allow a significant movement of the jaws 124 and 124A between their rest position and their anchoring position, whereas generally prior-art means were incapable of doing so.

The arrangement according to the invention thus makes it possible to achieve satisfactory anchoring beyond a restriction, owing to the great range of movement allowed for the jaws 124 and 124A.

Figure 2:
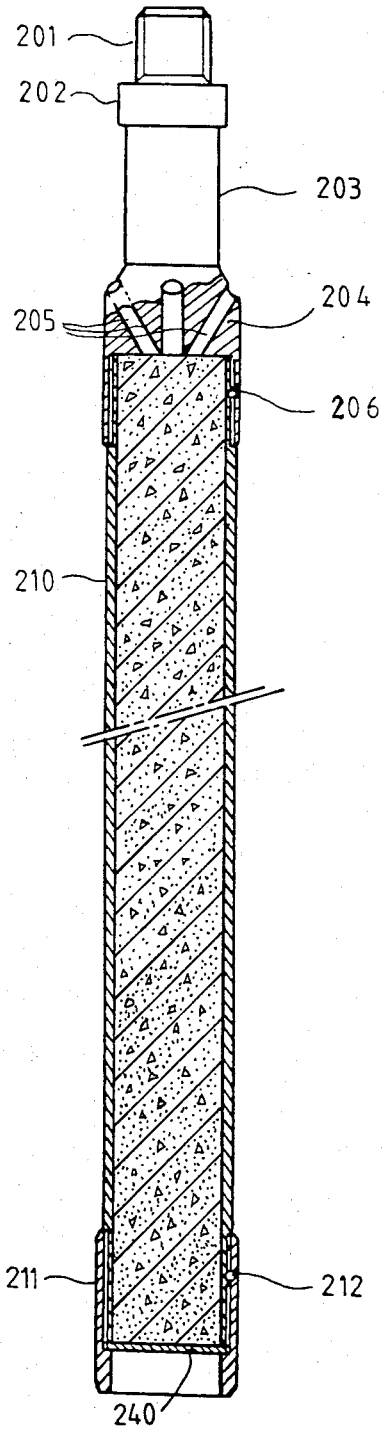
FIG. 2 represents a cement bailer according to the invention.

The second embodiment of the invention is illustrated in FIG. 2 in the form of a cement bailer. The head piece 203 is provided with a flange 202 and a threaded upward extension 201. The lower end of head piece 203 forms a cover 204 perforated at 205. A cylindrical tube 210 is secured inside the cover 204 by a pin 206. A pad 211 secured on the bottom of the cylindrical tube 210 by a pin 212 applies a disk 240 against the end of the tube.

This disk 240 is made of a fusible material according to the invention.

In this case also, a tool of this type is capable of different applications, notably those consisting in cementing a well beyond a restriction. Furthermore, the use of this cement bailer is faster than in the prior art where it was often necessary to wait for the cement to begin solidifying before bringing in another cement bailer to continue the cementation.

Two examples are given below to illustrate respectively the implementation of the two tools described.

EXAMPLE 1

Tools as illustrated in FIGS. 1A and 1B have been provided with fusible pins, one melting at 70° C. and the other at 120° C.

The compositions of the alloys used for the pins were the following:

at 70° C.:
- 50% bismuth
- 25% lead
- 12.5% zinc
- 12.5% cadmium at 120° C.:
- 1% zinc
- 55% bismuth
- 44% lead It was possible to install these anchoring tools under very difficult conditions, namely in a well deviated in depth, equipped with a production tubing having an intermediate part of smaller diameter than the upper and lower parts. These tools all proved satisfactory, whereas prior art anchoring means could practically not operate.

EXAMPLE 2

A tool according to FIG. 2 was made with, for the part 240, a disk of "ceroben" of 2-mm thickness and 40-mm diameter which melted at 120° C. Its composition was the same as the alloy indicated in Example 1.

In this manner, twelve cement bailers (eleven for cement and one for sand) were placed successively at a depth of about 5000 meters, successfully and very rapidly.

U.S. Pat. No. 4,390,291 gives the composition of alloys melting at various temperatures.

Of course, the present invention is not limited to the particular tools just described.

Based upon the storage of energy by a spring as used in FIG. 1, it is possible to provide a fusible pin whose melting will in turn drive a second stronger pin which will in turn trigger the tool, but with a greater energy, stored for example in a second spring. One thus achieves mechanical amplification to obtain the energy required for triggering the tool.

Conversely, instead of the "gate" 240 of the tool in FIG. 2 being entirely in fusible material, it would also be possible to provide a gate loaded to open by means of an elastic return, or simply by gravity, and kept in place by a fusible lock.

The invention can also be applied to other types of tools and in particular to the downhole placing of fragile electronic instruments or the downhole actuation of material samplers.

What is claimed is:

1. A method for actuating a tool in a well at a chosen depth, comprising the following steps:
- determining the temperature of the well at the chosen depth;
- equipping the tool with a central element comprising a material capable of melting at a temperature near the temperature thus determined;
- lowering the tool into the well to the chosen depth; and
- maintaining the tool in the well at the chosen depth until actuation of the tool by the melting of the control element material.

2. A method as defined in claim 1, wherein energy is stored in the tool in the equipping step and released for actuation of the tool upon the melting of the control element material in the maintaining step.

3. A method as defined in claim 1 or 2 wherein the tool is equipped with a control element material that melts at a temperature equal to or lower than the temperature of the well at the chosen depth; and wherein the tool is maintained at the chosen depth for a waiting time that is related to the thermal equilibrium time between the tool and the well.

4. A method as defined in claim 1, wherein the melting temperature of the material is defined with an accuracy of ±5° C.

5. A method as defined in claim 4, wherein the melting temperature of the material is defined with an accuracy of ±2° C.

6. A downhole tool designed to be actuated in response to the temperature of a well at a chosen well depth, comprising:
- a body member adapted to be lowered into a well at the end of a cable;
- energy storage means associated with said body member for storing energy in said tool prior to lowering said body member into said well; and control means comprising a material that melts at a temperature near the temperature of said well at said chosen depth and cooperable with said energy storage means for releasing said stored energy to cause actuation of said tool.

7. A tool as defined in claim 6, wherein said energy storage means comprises a movable element positioned for movement with respect to said body member between a first position and a second position relative thereto; and wherein said control means comprises a fusible part securing said movable element in said first position.

8. A tool as defined in claim 7, wherein said energy storage means further comprises biasing means for biasing said movable element into said second position; whereby melting of said fusible part in response to the well temperature at said chosen well depth will cause said movable element to move to said second position under the action of said biasing means.

9. A tool as defined in claim 8, wherein said body member comprises a rod including an expansion cone portion, said movable element comprises jaws slidably mounted on said rod, said biasing means comprises a spring urging said jaws toward said cone portion, and said fusible part comprises a pin locking said jaws away from said cone portion against the bias of said spring.

10. A tool as defined in any of claims 6, 8 or 9, wherein the melting material is made of a metallic alloy capable of melting substantially cleanly at a predetermined temperature between about 45° C. and 400° C., said temperature being defined within an accuracy of ±5° C.

11. A tool as defined in claim 11, wherein said alloy comprises mainly bismuth, as well as at least one of the elements lead and zinc.

* * * * *